US009403201B2

(12) United States Patent
Ishimori et al.

(10) Patent No.: US 9,403,201 B2
(45) Date of Patent: Aug. 2, 2016

(54) METHOD FOR MANUFACTURING FLAT PIPE

(71) Applicant: HINO MOTORS, LTD., Hino-shi (JP)

(72) Inventors: Takashi Ishimori, Tokyo (JP); Masayuki Okano, Tokyo (JP)

(73) Assignee: HINO MOTORS, LTD., Hino-shi (JP)

( * ) Notice: Subject to any disclaimer, the term of this patent is extended or adjusted under 35 U.S.C. 154(b) by 0 days.

(21) Appl. No.: 14/413,271

(22) PCT Filed: Oct. 24, 2013

(86) PCT No.: PCT/JP2013/006316

§ 371 (c)(1),
(2) Date: Jan. 7, 2015

(87) PCT Pub. No.: WO2014/068926

PCT Pub. Date: May 8, 2014

(65) Prior Publication Data

US 2015/0135795 A1 May 21, 2015

(30) Foreign Application Priority Data

Oct. 29, 2012 (JP) ..... 2012-237552

(51) Int. Cl.
*B21D 5/16* (2006.01)
*B21D 53/00* (2006.01)
(Continued)

(52) U.S. Cl.
CPC *B21D 5/16* (2013.01); *B21D 5/015* (2013.01); *B21D 28/02* (2013.01); *B21D 35/001* (2013.01);
(Continued)

(58) Field of Classification Search
CPC ..... B21D 5/16; B21D 28/02; B21D 35/002; B21D 53/02; B21D 5/015; B21D 35/001; B21D 53/04; B21D 53/06
See application file for complete search history.

(56) References Cited

U.S. PATENT DOCUMENTS 5,243,842 A * 9/1993 Kobayashi ..... B21C 37/06 29/890.052
6,915,821 B2 * 7/2005 Ooyauchi ..... B21C 37/06 138/177
2001/0049878 A1 12/2001 Kato et al.

FOREIGN PATENT DOCUMENTS

JP 10-122778 A 5/1998
JP 11-63872 A 3/1999
(Continued)

OTHER PUBLICATIONS

International Search Report issued Jan. 21, 2014 in PCT/JP2013/006316 filed Oct. 24, 2013.

*Primary Examiner* — Teresa M Ekiert
(74) *Attorney, Agent, or Firm* — Oblon, McClelland, Maier & Neustadt, L.L.P

(57) ABSTRACT

A method for manufacturing a flat pipe 1 with concave-convex shapes on inner and outer surfaces includes making incisions with an expanded shape of the flat pipe 1 in a metal thin plate 2 such that intermediate portions 4 (middle portions) in the expanded shape of the flat pipe 1 widthwise of the expanded shape are left uncut from the thin plate 2, machining the concave-convex shapes in a range of the expanded shape of the flat pipe 1 and raising the expanded shape of the flat pipe 1 from the thin plate 2 as cut-and-raised pieces 8 with the uncut intermediate portions 4 in between, closing tips of the cut-and-raised pieces 8 together to form an overall shape of the flat pipe 2, and separating the uncut intermediate portions 4 from the thin plate 2 to obtain the flat pipe 1.

3 Claims, 4 Drawing Sheets

(51) Int. Cl.

| | |
|---|---|
| ***B21D 35/00*** | (2006.01) |
| ***B21D 5/01*** | (2006.01) |
| ***B21D 53/06*** | (2006.01) |
| ***F28F 1/42*** | (2006.01) |
| ***F28F 1/02*** | (2006.01) |
| ***B21D 28/02*** | (2006.01) |
| ***B21D 53/04*** | (2006.01) |

(52) U.S. Cl.
CPC ..... *B21D 35/002* (2013.01); *B21D 53/04* (2013.01); *B21D 53/06* (2013.01); *F28F 1/025* (2013.01); *F28F 1/426* (2013.01); *F28F 2001/428* (2013.01); *F28F 2255/08* (2013.01)

(56) References Cited

FOREIGN PATENT DOCUMENTS

| | | | |
|---|---|---|---|
| JP | 2000-345925 | A | 12/2000 |
| JP | 2001-254649 | A | 9/2001 |

* cited by examiner

METHOD FOR MANUFACTURING FLAT PIPE

TECHNICAL FIELD

The present invention relates to a method for manufacturing a flat pipe.

BACKGROUND ART

For example, in a shell-and-tube heat exchanger or the like, a plurality of heat-transfer pipes are carried in a shell such that a primary medium flowing through the pipes are heat-exchanged with a secondary medium flowing through the shell. It has been already proposed, for example, in undermentioned Patent Literatures 1 and 2 that outer peripheries of the heat-transfer pipes are formed with spiral grooves which provide spiral protrusions, as inverse formations, on inner peripheries of the pipes to swirl the primary medium flowing through the pipes, thereby increasing contact frequency and contact distance of the primary medium to the inner peripheries of the pipes to enhance the heat exchange efficiency.

Such structure with the plural heat-transfer pipes in parallel with each other in the shell has a problem that the heat exchanger as a whole becomes large in structure due to lowness in heat exchange duty per unit volume and thus has deteriorated mountability to instrument/equipment. Thus, as exemplarily shown in FIG. 1, it has been started to study a flat pipe a shaped like cylindrical pipes arranged planarly and mutually proximately and connected together at mutually proximate portions thereof as communicating portions, cylindrical pipe portions b of the pipe a corresponding to the above-mentioned cylindrical pipes having inner peripheries formed with swirling-flow-forming protrusions c along spiral trajectories coaxial with central axes O of the portions b so that swirling flows of the medium d may be individually formed in the respective portions b (Japanese Patent Application No. 2011-220778).

CITATION LIST

Patent Literature

[Patent Literature 1] JP 2000-345925A
[Patent Literature 2] JP 2001-254649A

SUMMARY OF INVENTION

Technical Problems

However, upon manufacturing of any flat pipe a with concave-convex shapes on inner and outer surfaces including the flat pipe a as mentioned in the above with respect to FIG. 1, it is difficult to form the flat pipe a without breaking down and/or distorting the concave-convex shapes. Thus, usually used for reliable manufacturing of this kind of flat pipe a is a technique of manufacturing upper and lower halves of the flat pipe a respectively which are then joined. Such technique provides two joints on laterally opposite sides of the flat pipe a, leading to a concern that manufacturing cost is substantially increased due to the two joints to be jointed, respectively, by welding or the like.

The invention was made in view of the above and has its object to provide a method for manufacturing a flat pipe capable of reducing a manufacturing cost more than ever before.

Solution to Problems

The invention is directed to a method for manufacturing a flat pipe with concave-convex shapes on inner and outer surfaces, characterized in that it comprises making incisions, with an expanded shape of the flat pipe, in a metal thin plate such that intermediate portions in said expanded shape of the flat pipe widthwise of the expanded shape are left uncut from said thin plate, machining the concave-convex shapes in a range of said expanded shape of the flat pipe and raising said expanded shape of the flat pipe from said thin plate as cut-and-raised pieces with said uncut intermediate portions in between, closing tips of the cut-and-raised pieces together to form an overall shape of the flat pipe, and separating said uncut intermediate portions from said thin plate to obtain the flat pipe.

In this way, the tips of the cut-and-raised pieces are closed together at a single joint, which halves the number of the joints in comparison with the conventional technique of manufacturing the upper and lower halves of the flat pipe, respectively, and joining the halves at two joints on laterally opposite sides thereof, respectively, leading to substantial reduction in workload in the troublesome joint joining work. Moreover, the manufacturing method can be conducted stepwise in a manufacturing-line work with a blank being partly left uncut from and conveyed together with a thin plate until the overall shape of the flat pipe is formed, thereby substantially enhancing an efficiency of the manufacturing process.

In the invention, the closed tips of the cut-and-raised pieces may be joined before the uncut intermediate portions are separated off from the thin plate. Alternatively, the closed tips of the cut-and-raised pieces may be joined after the uncut intermediate portions are separated off from the thin plate.

Advantageous Effects of Invention

The method for manufacturing the flat pipe as mentioned in the above can exhibit excellent effects. A number of joints to be joined is reduced to one, which can substantially reduce workload in the troublesome joint joining work. Moreover, the manufacturing method can be conducted stepwise in a manufacturing-line work with a thin plate being conveyed, thereby substantially enhancing an efficiency of the manufacturing process. This can substantially reduce the manufacturing cost in comparison with the conventional technique of manufacturing upper and lower halves of a flat pipe, respectively, and joining two joints on laterally opposite sides thereof, respectively.

DESCRIPTION OF EMBODIMENT

Figure 1:
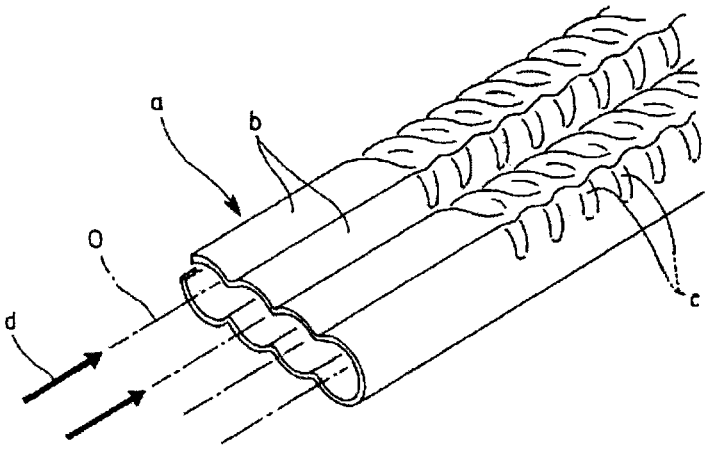
FIG. 1 is a perspective view showing an example of a flat pipe with concave-convex shapes on inner and outer surfaces.

An embodiment of the invention will be described in conjunction with the drawings.

FIGS. 2-7 show the embodiment of the invention schematically showing a method for manufacturing a flat pipe 1 with concave-convex shapes on inner and outer surfaces. Though the flat pipe 1 appears firstly in FIG. 7 for a final step of the method, for explanation convenience the flat pipe is referred to together with its reference numeral early in description on initial steps while referring to FIG. 7.

Figure 2:
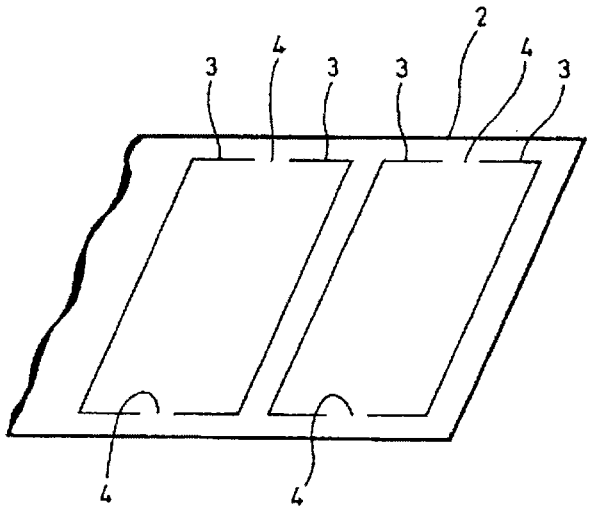
FIG. 2 is a perspective view schematically showing a first step in the embodiment of the invention.

FIG. 2 shows a first step in the method for manufacturing the flat pipe according to the embodiment. In the first step, a metal thin plate 2 is punched out in an expanded shape of the flat pipe 1 (see FIG. 7) to provide incisions 3 with the expanded shape in the thin plate 2 such that the expanded shape of the flat pipe 1 has middle portions 4 (intermediate portions) widthwise of the expanded shape (laterally in FIG. 2; longitudinally of the thin plate 2) which are left uncut from the thin plate 2.

Useable as the metal material for the thin plate 2 is, for example, stainless steel or other ferrous material, non-ferrous metal material such as aluminum, copper or titanium, refractory metal material such as nickel, cobalt or molybdenum, low-melting-point metal material such as lead or tin, precious metal material such as gold, silver or platinum, or any alloy thereof.

Figure 3:
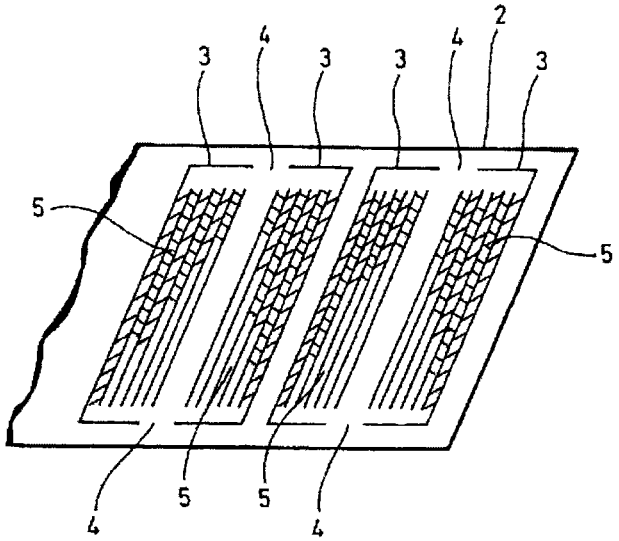
FIG. 3 is a perspective view schematically showing a second step in the embodiment of the invention.

FIG. 3 shows a second step in the method for manufacturing the flat pipe according to the embodiment. In the second step, the concave-convex shapes 5 on the inner and outer surfaces are machined in a range defined by the expanded shape of the flat pipe 1 (the range defined by the incisions 3) by press working. Though roughly shown here, formed are, for example, the cylindrical pipe portions b, the swirling-flow-forming protrusions c and the like in the above-mentioned FIG. 1.

Figure 4:
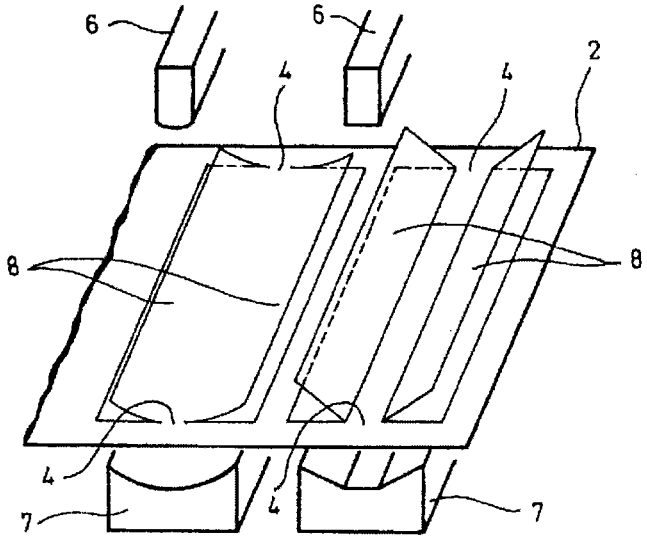
FIG. 4 is a perspective view schematically showing a third step in the embodiment of the invention.

FIG. 4 shows a third step in the method for manufacturing the flat pipe according to the embodiment. In the third step, upper and lower molds 6 and 7 are used to raise the expanded shape of the flat pipe 1 from the thin plate 2 with the uncut middle portion 4 in between (reference numeral 8 in FIG. 4 denotes cut-and-raised pieces from the thin plate 2).

Shown left and right in FIG. 4 are cases where the flat pipes 1 with elliptical and rectangular cross-sections are fabricated, respectively. In FIG. 4, the concave-convex shapes 5 formed with respect to the previous FIG. 3 are not shown from a viewpoint of facilitated visualization.

Figure 5:
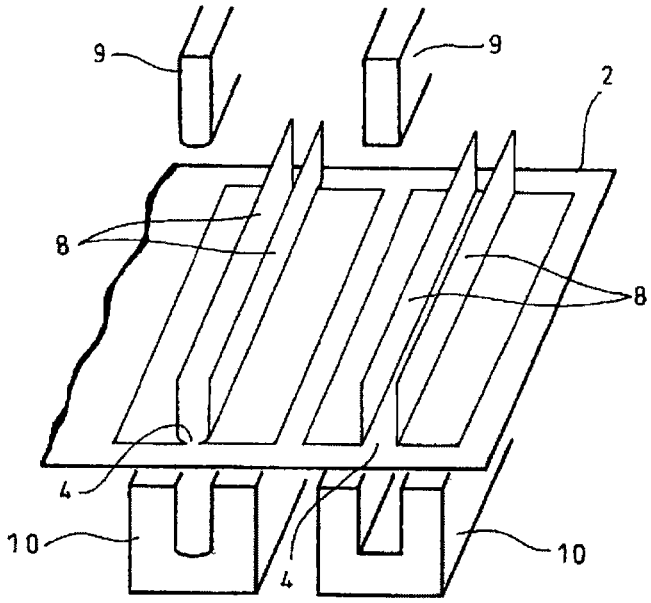
FIG. 5 is a perspective view schematically showing a fourth step in the embodiment of the invention.

FIG. 5 shows a fourth step in the method for manufacturing the flat pipe according to the embodiment. In the fourth step, upper and lower molds 9 and 10 are used to further raise the cut-and-raised pieces 8 from the thin plate 2 into uprightness. Then, in a fifth step shown in FIG. 6, an upper mold 11 is used to fold tips of the cut-and-raised pieces 8 inward into co-closure, thereby forming the overall shape of the flat pipe 1.

Specifically, in the embodiment illustrated, the flat pipe 1 is formed with one of lateral surfaces on the flat pipe 1 being left uncut from the thin plate 2 and with the other lateral surface being raised upward, the other lateral surface being formed by closing the tips of the cut-and-raised pieces 8 together inward.

When portions of the flat pipe 1 pushed by the molds 6 and 7 and 9 and 10 in FIGS. 4 and 5 are also desired to have concave-convex shapes, it is possible to make the molds 6 and 7 and 9 and 10 themselves formed with impressions for forming the concave-convex shapes so that the concave-convex shapes 5 (see FIG. 3) are applied upon raising of the cut-and-raised pieces 8 from the thin plate 2.

Figure 6:
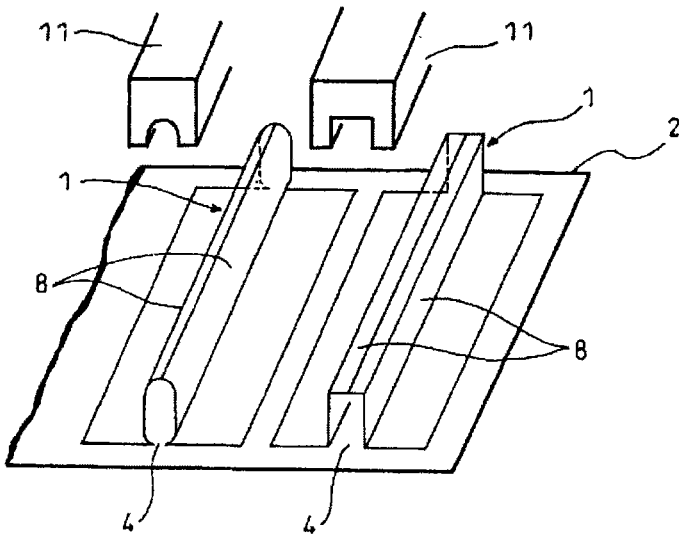
FIG. 6 is a perspective view schematically showing a fifth step in the embodiment of the invention.

Upon using the upper mold 11 to fold the tips of the cut-and-raised pieces 8 inward into co-closure in the fifth step in FIG. 6, backing material (not shown) complemental in shape to the upper mold 11 may be applied inside of the cut-and-raised pieces 8 raised to receive the upper mold 11.

In the description on the embodiment, the upper mold 11 is used in the fifth step in FIG. 6 to fold the tips of the cut-and-raised pieces 8 inward into co-closure. Alternatively, it is possible, for example, to preliminarily fold the tips of the cut-and-raised pieces 8 in the third step in FIG. 4 so that when the cut-and-raised pieces 8 are further raised into uprightness in the fourth step in FIG. 5, the tips of the cut-and-raised pieces 8 are closed together.

Figure 7:
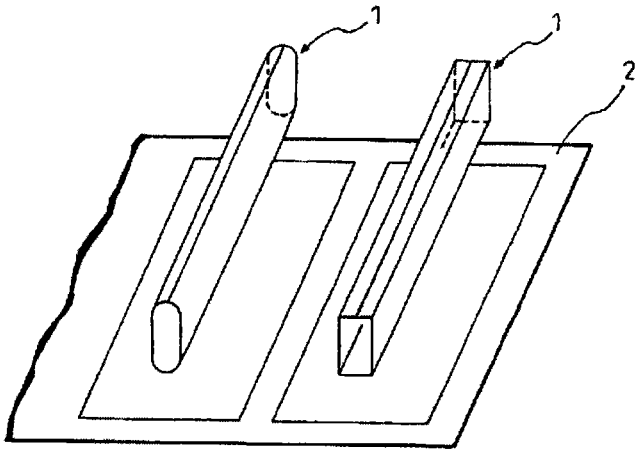
FIG. 7 is a perspective view schematically showing a sixth step in the embodiment of the invention.

FIG. 7 shows a sixth step in the method for manufacturing the flat pipe according to the embodiment. In the sixth step, the uncut middle portions 4 (see FIGS. 2-6) are separated off from the thin plate 2 to obtain the flat pipe 1. With respect to the closed tips of the cut-and-raised pieces 8, the joining may be made between the fifth and sixth steps before the uncut middle portions 4 are separated off from the thin plate 2; alternatively, the joining may be made after the sixth step and after the uncut middle portions 4 are separated off from the thin plate 2. As to at what timing the joining is to be conducted, selection may be appropriately made depending on easiness of a welding work.

In this occasion, for the joining of the closed tips of the cut-and-raised pieces 8, adhesive may be used, for example, especially when the metal material for the thin plate 2 is aluminum. However, preferably, welding is used for joining the joint including a base material through fusing, bearing in mind, for example, a fact that corrosive environment may be provided by a medium to be passed through the flat pipe 1. More specifically, laser welding is preferable such as carbon dioxide laser welding, YAG laser welding or excimer laser welding. The closed tips of the cut-and-raised pieces 8 may be welded by butt welding or by lap welding.

Alternatively, the closed tips of the cut-and-raised pieces 8 may be joined by brazing or soldering. In such occasion, the overall shape of the pipe requires to be accommodated in a heating chamber for heating, so that it is preferably conducted after the uncut middle portions 4 are separated off from the thin plate 2.

Inner or/and outer surfaces of the flat pipe 1 separated off from the thin plate 2 may be machined to have surface finishing such as coating or plating, as need arises.

In this way, the tips of the cut-and-raised pieces 8 are closed together at a single joint, which halves the number of the joints in comparison with the conventional technique of manufacturing the upper and lower halves of the flat pipe 1, respectively, and joining the halves at two joints on laterally opposite sides thereof, respectively, leading to substantial reduction in workload in the troublesome joint joining work. Moreover, the manufacturing method can be conducted stepwise in a manufacturing-line work with a blank being partly left uncut from and conveyed together with a thin plate 2 until the overall shape of the flat pipe 1 is formed, thereby substantially enhancing an efficiency of the manufacturing process.

Thus, according to the above-mentioned embodiment, a number of joints to be joined is reduced to one, which can substantially reduce workload in the troublesome joint joining work. Moreover, the manufacturing method can be conducted stepwise in a manufacturing-line work with a thin plate 2 being conveyed, thereby substantially enhancing an efficiency of the manufacturing method. This can substantially reduce the manufacturing cost in comparison with the conventional technique of manufacturing upper and lower halves of a flat pipe, respectively, and joining two joints on laterally opposite sides thereof, respectively.

It is to be understood that a method for manufacturing a flat pipe according to the invention is not limited to the above embodiment and that various changes and modifications may be made without departing from the scope of the invention.

For example, concave-convex shapes on inner and outer peripheries of a flat pipe are not restricted to those in the embodiment illustrated. Moreover, upon making incisions with a expanded shape of the flat pipe in a metal thin plate, portions to be left uncut from the thin plate are not always restricted to middle portions widthwise of a flat pipe and may be intermediate portions widthwise of the flat pipe.

REFERENCE SIGNS LIST

1 flat pipe
2 thin plate
3 incision
4 middle portion (intermediate portion)
5 concave-convex shape
8 cut-and-raised piece

The invention claimed is:

1. A method for manufacturing a flat pipe with concave-convex shapes on inner and outer surfaces, which comprises:

making incisions in a metal thin plate to provide a part having an expanded shape of the flat pipe, such that intermediate portions in said expanded shape of the flat pipe, provided widthwise of the expanded shape, are left uncut from said metal thin plate, machining the concave-convex shapes on inner and outer surfaces in a portion of said part having the expanded shape of the flat pipe, using upper and lower pressing molds to raise a region of said expanded shape of the flat pipe from said metal thin plate as cut-and-raised pieces with said uncut intermediate portions in between the raised regions, closing tips of the cut-and-raised pieces together to form an overall shape of the flat pipe, and after the step of using upper and lower pressing molds to raise a region of said expanded shape of the flat pipe from said metal thin plate, separating said uncut intermediate portions from said metal thin plate to obtain the flat pipe.

2. The method for manufacturing the flat pipe as claimed in claim 1, wherein the closed tips of the cut-and-raised pieces are joined before the step of separating the uncut intermediate portions from the metal thin plate.

3. The method for manufacturing the flat pipe as claimed in claim 1, wherein the closed tips of the cut-and-raised pieces are joined after the step of separating the uncut intermediate portions from the metal thin plate.

* * * * *